US005510872A

United States Patent [19]

Franci et al.

[11] Patent Number: 5,510,872

[45] Date of Patent: Apr. 23, 1996

[54] DEVICE FOR AUTOMATIC COMPENSATION OF THE LEVEL OF CHEMICAL TREATMENT BATHS, APPLICABLE IN PARTICULAR TO DEVELOPING MACHINES

[75] Inventors: Giosué Franci; Ennio Pessot; Daniele Bravin, all of Pordenone; Danny Lant, Udine; Dragan Raus, Pordenone, all of Italy

[73] Assignee: San Marco Imaging S.r.l., Pordenone, Italy

[21] Appl. No.: 257,286

[22] Filed: Jun. 9, 1994

[30] Foreign Application Priority Data

Jun. 10, 1993 [IT] Italy ..... PN93A0038

[51] Int. Cl.[6] ..... G03D 3/02

[52] U.S. Cl. ..... 354/324; 354/325

[58] Field of Search ..... 354/319–325, 354/328; 134/64 P, 64 R, 122 P, 122 R

[56] References Cited

U.S. PATENT DOCUMENTS

| | | | |
|---|---|---|---|
| 4,371,250 | 2/1983 | Wakabayshi et al. | 354/325 |
| 4,839,683 | 6/1989 | Kushima et al. | 354/322 |
| 5,059,998 | 10/1991 | Sasaki et al. | 354/324 |
| 5,369,458 | 11/1994 | Wernicke et al. | 354/319 |
| 5,379,085 | 1/1995 | Matsuda et al. | 354/321 X |

FOREIGN PATENT DOCUMENTS

| | | | |
|---|---|---|---|
| 599147 | 6/1994 | European Pat. Off. | 354/320 |
| 62-240970 | 10/1987 | Japan | 354/320 |
| 3-59655 | 3/1991 | Japan | 354/324 |

*Primary Examiner*—D. Rutledge
*Attorney, Agent, or Firm*—Wenderoth, Lind & Ponack

[57] ABSTRACT

The level of chemical treatment baths is automatically, compensated, in film developing machines. A vessel (90) contains a supply of water which is directed by a pump (50) and a pipeline (51) through a manifold (7) to baths (11, 12, 13, 14, 15) by way of feed pipelines (71, 72, 73, 74, 75). Each pipeline is controlled by respective solenoid valve (61, 62, 63, 64, 65) controlled to operate simultaneously with the pump (50) by way of an electronic control unit (41) in receipt of signals relayed from sensors (21, 22, 23, 24, 25) designed to detect a drop in the level of the solutions in the baths (11, 12, 13, 14, 15). The feed outlets of the pipelines (71, 72, 73, 74 75) discharge above the level of the baths (11, 12, 13, 14, 15) so as to prevent any possibility of reflux. In the case of the pipeline (75) serving the final bath (15), water is supplied by way of a tubular element (81) with holes (85) strategically placed to generating jets directed onto at least one roller (321) of a set of paired squeeze rollers (32).

14 Claims, 1 Drawing Sheet

DEVICE FOR AUTOMATIC COMPENSATION OF THE LEVEL OF CHEMICAL TREATMENT BATHS, APPLICABLE IN PARTICULAR TO DEVELOPING MACHINES

BACKGROUND OF THE INVENTION

The present invention relates to a device for automatically controlling and compensating the level of chemical treatment baths that has particular application to automatic machines for developing photographic film and/or exposed light-sensitive paper. More precisely, the present invention allows automatic compensation for the loss of water through evaporation from such baths. Conventionally, in automatic machines for developing exposed photographic film or printed light-sensitive paper, known as film developers and print developers, sets of baths containing aqueous solutions of suitable chemical products are required for the progressive implementation of various processing stages through which a film or paper to be treated will be gradually directed.

Likewise conventionally, the entire operation is carried out at a temperature of 40° C., approximately, and the interior of a relative enclosure is continuously ventilated for the purpose of expelling such vapors as may be given off.

During such an operation, the passage of the film or paper through the treatment baths will occasion a gradual depletion of the solution. This is compensated by the addition of corresponding fresh chemical solutions, a step piloted automatically on the basis of the surface treated.

Beside depletion by consumption, with liquid being removed gradually as the treated film or paper is fed through, there is at the same time a certain loss due to evaporation of the water in the different solutions, occasioning a drop in the level of the various baths, which hitherto has been manually compensated by adding an appropriate quantity of water.

Whether processing is interrupted temporarily, with breaks occurring normally once per day and lasting for a full shutdown period, typically from the evening when operation is suspended through to the following morning, or more especially where breaks are of longer duration, such as at weekends or over holiday periods, when stoppages may even run into a number of days, the evaporation of water occasions a corresponding pronounced drop in the level of the baths, to a greater or lesser degree. This cannot be compensated simply by the addition of new solution, as this would result in a progressively higher concentration, tending to change the characteristics of treatment. Besides, further drawbacks may be brought on, namely, the formation of deposits due to crystallization on the components by which the film or paper is conveyed through the various treatment baths, and consequently a degradation of their ultimate characteristics.

Moreover, film or paper feed rollers not immersed in the relative baths are continuously moistened during operation by the solution carried onto their surfaces by the running film or paper. As a result of the drying which occurs during shutdown periods, prolonged or otherwise, deposits of the chemical substances from the solutions are left on the rollers. Normally, this does not cause difficulties in the case of the rollers by which film or paper is transferred from one bath to the next, since as the machine resumes operation these rollers are immediately moistened, and any deposits left on their surfaces will be redissolved and removed.

However, it is common, particularly in the case of film developers, for the machine to be equipped with devices positioned at the point of exit from the final bath and designed to effect a suitable uniform removal of the greater part of the solution still clinging to the opposite surfaces of the film, thereby avoiding the formation of haloes and/or stains during the successive drying stage, which besides spoiling the appearance of the film can also lead to problems with its subsequent reproduction. In a conventional solution, such devices consist of two pairs of rollers fashioned from a suitable porous and flexible material. The two rollers of each pair are disposed in mutual opposition and pressed one against the other in such a manner that the covering of liquid clinging to a film passing between them will be removed uniformly.

These rollers, commonly referred to as squeeze rollers, will themselves clearly be moistened during operation by the selfsame solution they are designed to remove, and thus remain impregnated. With the evaporation of water from the impregnating solution during periods when the operation is suspended, deposits are formed due to crystallization of the substances dissolved in the solution. The deposits are unable to redissolve quickly at the moment when operation is resumed, and thus the deposits in question can cause damage even of a notable and irreparable nature, particularly to the first film with which contact is made after resumption of operation.

SUMMARY OF THE INVENTION

The object of the present invention is to overcome the aforementioned drawbacks. This object is realized in the disclosed invention which employs simple, reliable and economical means for not only automatically compensating evaporation losses from the chemical treatment baths in a permanent and continuous manner by adding water, but also of utilizing the added water to moisten and thereby deencrust the squeeze rollers, which, not being immersed in the baths, are most affected by the above-discussed drawbacks.

BRIEF DESCRIPTION OF THE DRAWINGS

To enable a better appreciation of the features and advantages afforded by the invention, the device will now be described in detail, strictly by way of example, with reference to the accompanying drawings, in which.

Identical parts are indicated by a common number in the above drawings.

DETAILED DESCRIPTION OF THE PREFERRED EMBODIMENT

Figure 1:
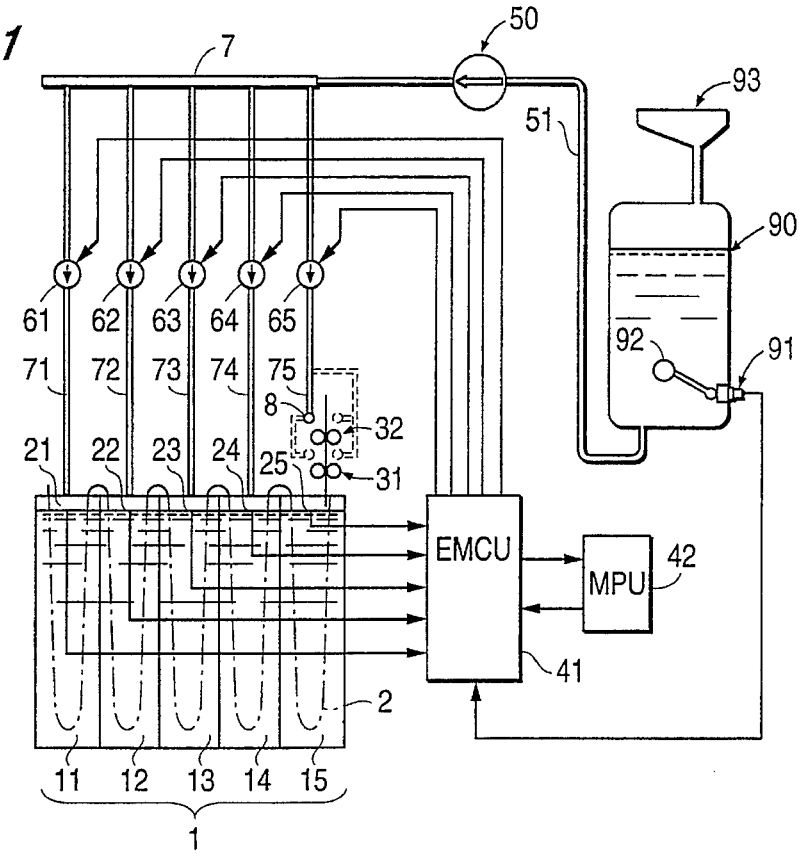
FIG. 1 is a schematic representation of a device to which the present invention relates, applied by way of example to a set of film treatment baths illustrated in longitudinal section.

Referring in particular to FIG. 1, a group of chemical treatment baths 1 for processing film 2 comprises, in a conventional manner, a first developing bath 11, and thereafter a whitening bath 12, a fixing bath 13 and finally two stabilizing baths 14 and 15.

In FIG. 1, the path followed by the film 2, which will be conveyed in a conventional manner and by conventional means, is indicated schematically, for the purposes of clarity and simplicity, by a dot-dash phantom line, with only the final stretch, and more exactly that portion emerging from the final stabilizing bath 15 and passing thence between two pairs of squeeze rollers 31 and 32 disposed one above the other, indicated by a bold line.

The treatment baths 11, 12, 13, 14 and 15 are occupied by respective sensors 21, 22, 23, 24 and 25 consisting of suitable devices of conventional structure designed to detect any lowering of the levels of the solutions contained in the baths. The sensors 21, 22, 23, 24 and 25 are connected electrically to an electronic monitoring and control unit 41 (EMCU), which in turn is connected to a main processing unit (MPU) 42 of the machine.

The baths 11, 12, 13, 14 and 15 are supplied in a manner to be described in due course by corresponding feed pipelines 71, 72, 73, 74 and 75 connected to a manifold 7, each of which is controlled by a respective solenoid valve 61, 62, 63, 64 and 65. The manifold 7 is in turn connected by way of a pump 50 and a feed pipeline 51 to a vessel 90 containing a supply of water from which to make up the level of the baths 11, 12, 13, 14 and 15. Naturally, the vessel 90 will be fitted with a safety device of conventional structure, for example a switch 91 also connected electrically to the electronic control unit 41, so as to indicate and cut off the operation of the pump and the solenoid valves 61, 62, 63, 64 and 65 in the event that the water in the vessel itself should fall to a minimum level or dry up altogether. A suitable filler 93 is also provided in order to replenish the vessel with fresh water when required. As already intimated, the periods of greater or lesser duration when operation of the machine is suspended will see not only a significant fall in the level of the solutions in the various baths due to evaporation of the water in the solutions, but also the formation of encrusting deposits which tend to cause drawbacks, likewise already intimated, especially on the squeeze rollers 31 and 32.

The level in the single treatment baths is topped up, in accordance with the solution to which the present invention relates, by supplying a relative quantity of water to each one in a controlled manner, as will now be described.

When the sensors 21, 22, 23, 24 and 25 detect a drop in the level of the solution contained in the respective baths 11, 12, 13 14 and 15, a relative signal is relayed to the electronic monitoring and control unit 41, which in turn is governed by the main processing unit 42 controlling and coordinating all the various functions of the developing machine. Accordingly, if the machine is operating under entirely normal conditions, then the signal returned by each single sensor 21, 22, 23, 24 and 25 will pilot the monitoring and control and processing units 41–42 to activate the pump 50 together with the corresponding solenoid valves 61, 62, 63 64 and 65. Water is now drawn from the vessel 90 by the pump 50, passing through the pipeline 51, into the manifold 7, then along the feed pipelines 71, 72, 73, 74 and 75 and the solenoid valve or valves 61, 62, 63, 64 and 65, which will be piloted to open, and ultimately into the corresponding baths 11, 12, 13, 14 and 15.

Naturally, each single bath of the baths 11, 12, 13, 14 and 15 continues to be replenished until restoration of the normal level is detected by the relative sensors 21, 22, 23, 24 and 25, and the respective solenoid valves 61, 62, 63, 64 and 65 are controlled to close.

As the levels of the baths 11, 12, 13, 14 and 15 return to normal and the corresponding solenoid valves 61, 62, 63, 64 and 65 are controlled gradually to close, the pump 50 continues to operate until the final sensor 21, 22, 23, 24 and 25 returns a signal indicating replenishment of the respective final bath 11, 12, 13, 14 and 15, and the pump is shut off.

Figure 2:
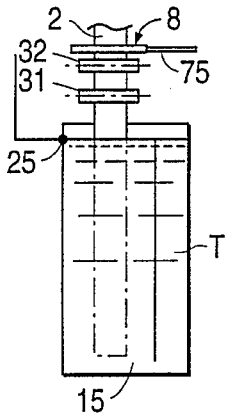
FIG. 2 is a schematic cross sectional view of a final chemical treatment bath illustrating an arrangement of feed means supplying water to compensate for losses through evaporation and simultaneously moisten squeeze rollers positioned at the point of exit from the bath.

In the case of the final bath 15 from which, as already mentioned, the emerging film 2 is directed between the pairs of squeeze rollers 31 and 32, which likewise as already mentioned become encrusted following prolonged pauses in operation, the water supplied by way of the relative feed pipeline 75 to top up the level of the solution is strategically directed onto the two pairs of rollers 31 and 32 by a special feed system designed to bring about their full and secure de-encrustation, which is described in due course. In a first possible embodiment, as discernible in FIGS. 1 and 2, but more especially in FIG. 4, such a feed system might comprise of at least one tubular element 81 suitable connected to the feed pipeline 75 and longitudinally disposed, parallel with and at an appropriate distance above one roller 321 of the uppermost pair of squeeze rollers 32. The tubular element 81 has a set of holes 85 strategically placed in such a way as to direct jets of water 86 both onto the top part of the one roller 321 and toward the central area encompassed by the uppermost pair 32.

Figure 5A:
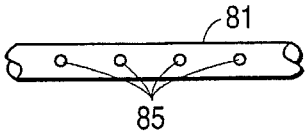
FIGS. 5(*a*) and (*b*) are enlarged views of a portion of FIG. 4.
Figure 5B:
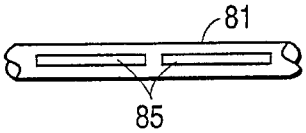

The holes 85 might consist of a plurality of circular apertures or in one or more longitudinal slots as seen in FIGS. 5(*a*) and (*b*), respectively. It will be observed that a further possible embodiment of the device might comprise not only a single tubular element 81 serving just one relative squeeze roller 321 but also, to advantage, a second tubular element 82 disposed symmetrically to the first and serving the remaining squeeze rollers 322 of the uppermost pair 32, and perhaps even two further tubular elements 83 and 84 disposed in the manner of the first and second tubular elements 81 and 82 over the respective squeeze rollers 311 and 312 of the lower pair 31.

Figure 4:
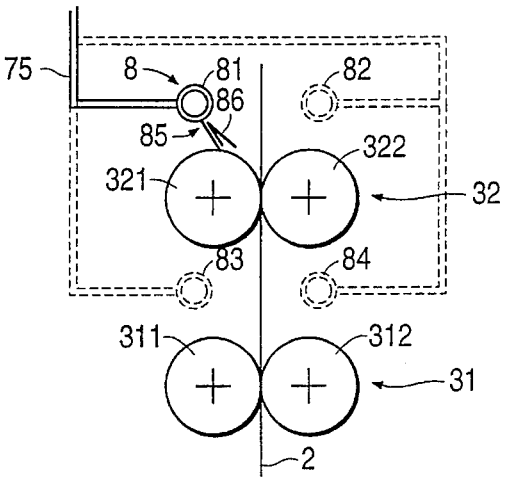
FIG. 4 is an enlarged sectional view illustrating a detail of the arrangement of feed means of FIG. 2.

Naturally these further tubular elements 82, 83 and 84, indicated by phantom lines in FIG. 4, will be coupled to the relative feed pipeline 75 in a similar fashion by way of suitable connections, also indicated with phantom lines.

This further arrangement, if moderately more complex and costly, allows for simultaneously serving at least the two squeeze rollers 321 and 322 of the top pair 32, and better still, all four squeeze rollers 321–322 and 311–312 of both pairs 31 and 32, thus obtaining a swifter and more uniform de-encrustation.

In the case of the preceding baths 11, 12, 13 and 14, the only rollers not entirely immersed in the relative solution are the topmost rollers of the pairs by which the film is transferred from one bath to the next, and accordingly, any deposits formed on these same rollers during prolonged shutdown periods will be moistened immediately and removed, once the machine has resumed operation, by the liquid carried on the corresponding bottom rollers: these are permanently immersed in the respective solutions, at least partially, and do not require the application of a feed system as envisaged for the final bath 15.

Figure 3:
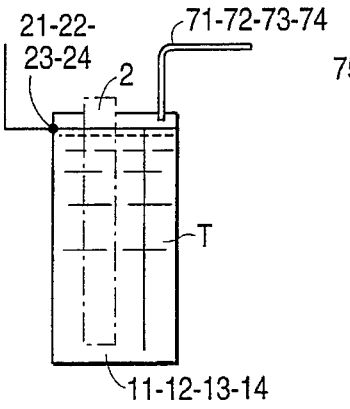
FIG. 3 is a further schematic and sectional view similar to FIG. 2, which illustrates a manner of supplying water exclusively to compensate for losses through evaporation from preceding chemical treatment baths.

The water used for topping up the solutions in these baths 11, 12, 13 and 14 can be introduced directly by way of the respective feed pipelines 71, 72, 73 and 74, which preferably will be disposed, as illustrated in FIG. 3, with their outlets discharging into side tanks T positioned generally on one side of the respective baths 11, 12, 13, 14 and 15 and, in a conventional manner, accommodating thermostat controlled heater elements together with elements for agitation and filtration of the respective solutions. In this instance, the feed pipelines denoted 71, 72, 73 and 74 will be installed in such a way that their outlets lie above the level of the solutions contained in the baths 11, 12, 13 and 14 and at a distance from the surface so as to preclude any possibility of the solutions refluxing, and thus preventing the risk of the solutions fouling one another or contaminating the reserve water supply. Such an arrangement therefore advantageously allows for dispensing with the application of non-return devices such as check valves or the like.

The advantages obtainable with the device to which the invention relates will be evident from the foregoing. In effect, the solution disclosed permits gaining not only the full advantages inherent in automatically maintaining the level of the various baths, as would be afforded by other automatic systems of conventional embodiments, in particular the possibility of avoiding errors liable to occur when the operation is performed manually, for example the additional of an excessive quantity of water resulting in over-diluted solutions, but also a notable simplification and a marked functional improvement over conventional systems based normally on the use of a plurality of pumps, typically one pump per single bath, and the installation of non-return devices.

It follows that the new device is in general much more simple, safe and dependable than equivalent conventional devices, and moreover, with the particular arrangement of the new feed system for the water used in replenishing the final bath 15, one has the further notable advantage of an automatic and secure method by which to moisten and thus effect the de-encrustation of the pairs of squeeze rollers 31 and 32.

Clearly, the device disclosed can be utilized not only for topping up the level of chemical treatment baths as used exclusively in processing film, but also, and to advantage in the same manner, for chemical treatment baths as employed for light-sensitive paper, whether in machines designed to process prints only or in machines incorporating both film and print processing systems in a single unit.

It will be appreciated that variations in the embodiment might be applied to the individual features of the elements making up the device to which the invention relates, without by any means abandoning the scope of the foregoing specification and the references to the accompanying drawings, nor straying from within the bounds of protection afforded by the appended claims.

We claim:

1. An apparatus, comprising:

a vessel containing a supply of water;

a first pipeline connecting said vessel to a manifold;

an electronic monitoring and control unit;

a main processing unit connected to said electronic monitoring and control unit for controlling said electronic monitoring and control unit;

a plurality of baths containing respective solutions therein, each of said plurality of baths having a respective sensor for detecting a drop in the level of solution therein connected to said electronic monitoring and control unit for relaying a signal corresponding to the level of solution to said electronic monitoring and control unit, said plurality of baths comprising a final bath having a squeeze roller assembly that includes a plurality of squeeze rollers located above said final bath;

a plurality of second pipelines each extending from said manifold to a respective one of said plurality of baths so as to be able to deliver water from said vessel to said baths;

a single pump connected to said first pipeline and said manifold for pumping the water from said vessel to said manifold and said plurality of second pipelines, said single pump being operable by said electronic monitoring and control unit in response to signals from said plurality of sensors;

a plurality of solenoid valves in respective ones of said plurality of second pipelines, said solenoid valves controlling the flow of water through said second pipelines and said solenoid valves being connected with and operated by said electronic monitoring and control unit in response to signals from said plurality of sensors;

wherein said second pipelines comprise ends located above the level of the solution in the respective baths such that the distance separating the respective said ends from the levels of the respective solutions creates a separation in flow from said ends to said baths sufficient to prevent any reflux from said baths to said pipelines; and wherein one of said second pipelines comprises at least one tubular element having apertures therein positioned above and parallel with one of said squeeze rollers of said squeeze roller assembly and above the level of the solution of said final bath.

2. The apparatus of claim 1, wherein said at least one tubular element having apertures therein comprises a plurality of tubular elements having apertures therein positioned above and parallel with respective ones of said plurality of squeeze rollers and above the level of the solution of said final bath.

3. The apparatus of claim 2, wherein said apertures in said tubular elements are circular.

4. The apparatus of claim 2, wherein said apertures in said tubular elements are longitudinal slots.

5. The apparatus of claim 1, wherein said apertures in said at least one tubular element are circular.

6. The apparatus of claim 1, wherein said apertures in said at least one tubular element are longitudinal slots.

7. An apparatus for automatically replenishing water in a plurality of treatment baths in a process, said apparatus comprising:

a vessel containing a supply of water;

a first pipeline having a pump therein, said first pipeline being connected to a manifold;

a plurality of second pipelines extending from said manifold to positions above respective ones of the plurality of treatment baths for supplying water from said vessel to the treatment baths;

solenoid valves in respective ones of said plurality of second pipelines;

means for detecting drops in the level of solution in the plurality of treatment baths and providing signals corresponding to the level of the solution; and control means for receiving the signals from said means for detecting and controlling said pump and said solenoid valves in response to the signals.

8. The apparatus of claim 7, wherein said means for detecting comprises sensors and said control means comprises an electronic monitoring and control unit.

9. The apparatus of claim 7, wherein said vessel comprises a level sensor connected with said control means.

10. The apparatus of claim 7, wherein one of said second pipelines has an end provided with at least one tubular element having a plurality of apertures therein such that said one of said second pipelines can distribute water over an elongated area.

11. The apparatus of claim 10, wherein said at least one tubular element comprises a plurality of tubular elements having a plurality of apertures therein.

12. The apparatus of claim 7, wherein the treatment baths are adjacent chemical baths in a film processing apparatus having a film path defined as extending through said baths, said film path having an end at which is located a final one of said baths, and the final one of said baths having a squeeze roller assembly located thereabove for squeezing the film as it exits the final one of said baths, and wherein one of said second pipelines has an end provided with at least one tubular element having a plurality of apertures therein such that said one of said second pipelines can distribute water over said squeeze roller assembly.

13. The apparatus of claim 12, wherein said at least one tubular element comprises a plurality of tubular elements having a plurality of apertures therein.

14. The apparatus of claim 13, wherein said squeeze roller assembly comprises two pairs of squeeze rollers and said plurality of tubular elements comprises one of said tubular elements for and positioned above each of said squeeze rollers.

* * * * *